United States Patent [19]

Mori

[11] Patent Number: 4,753,049

[45] Date of Patent: Jun. 28, 1988

[54] METHOD AND APPARATUS FOR GRINDING THE SURFACE OF A SEMICONDUCTOR

[75] Inventor: Toshiyuki Mori, Tokyo, Japan

[73] Assignee: Disco Abrasive Systems, Ltd., Tokyo, Japan

[21] Appl. No.: 928,707

[22] Filed: Nov. 7, 1986

Related U.S. Application Data

[62] Division of Ser. No. 690,901, Jan. 14, 1985, abandoned.

[30] Foreign Application Priority Data

Jan. 23, 1984 [JP] Japan ..... 59-8534

[51] Int. Cl.[4] ..... B24B 7/00

[52] U.S. Cl. ..... 51/131.3; 51/131.5; 51/215 HM; 51/215 M; 198/394

[58] Field of Search ..... 51/281 R, 281 SF, 283, 51/131.3, 131.5, 235, 134, 215 R, 215 AR, 215 HM, 215 E, 215 M; 414/225, 754, 331; 198/394, 395, 379

[56] References Cited

U.S. PATENT DOCUMENTS

| | | | |
|---|---|---|---|
| 3,650,074 | 3/1972 | Weinz | 51/283 X |
| 3,865,254 | 2/1975 | Johannsmeier | 198/394 X |
| 4,481,738 | 11/1984 | Tabuchi | 51/131.5 X |
| 4,483,434 | 11/1984 | Miwa et al. | 198/394 |

FOREIGN PATENT DOCUMENTS

| | | | |
|---|---|---|---|
| 33835 | 4/1981 | Japan | 269/21 |
| 152562 | 11/1981 | Japan . | |
| 0089551 | 6/1982 | Japan | 51/281 R |
| 156157 | 9/1982 | Japan . | |

*Primary Examiner*—Debra Meislin

*Attorney, Agent, or Firm*—Beveridge, DeGrandi & Weilacher

[57] ABSTRACT

A method and an apparatus for grinding the surface of a semiconductor wafer by moving a holding table and a grinding wheel relative to each other in a predetermined direction substantially parallel to the surface of the semiconductor wafer held onto the holding table to cause the grinding wheel which is rotated to act on the surface of the semiconductor wafer held onto the holding table. The semiconductor wafer is placed on the holding table with its angular position being regulated so as to direct its crystal orientation in a predetermined direction with respect to the holding table, and thus the grinding direction of the surface of the semiconductor wafer by the grinding wheel is set in a predetermined relationship to the crystal orientation of the semiconductor wafer. At the periphery of the semiconductor wafer is formed a deformed portion arranged at a predetermined angular position with respect to its crystal orientation, and the holding table has a vacuum suction area made of a porous material and shaped substantially correspondingly to the shape of the semiconductor wafer.

5 Claims, 5 Drawing Sheets

METHOD AND APPARATUS FOR GRINDING THE SURFACE OF A SEMICONDUCTOR

This application is a division of application Ser. No. 690,901, filed Jan. 14, 1985, now abandoned.

FIELD OF THE INVENTION

This invention relates to a method and an apparatus for grinding the surface of a semiconductor wafer, and more specifically, to a method and an apparatus for grinding the surface of a semiconductor wafer by rotating a grinding wheel and moving the grinding wheel and the semiconductor wafer relative to each other.

DESCRIPTION OF THE PRIOR ART

As is well known, the production of semiconductor devices requires to grind the surface of a semiconductor wafer to make the thickness of the semiconductor wafer a required value. It has been the previous practice to carry out the grinding of the surface of a semiconductor wafer by lapping or polishing using loose abrasive grains. The grinding of the surface of a semiconductor wafer by the lapping or polishing, however, has the problems or defects that (a) the semiconductor wafer and its environment are contaminated with the loose abrasive grains; (b) its productivity is low; and (c) it is difficult for automation.

As a grinding method and apparatus to solve the problems or defects, therefore, a method and apparatus using a grinding wheel having a grinding blade formed by bonding abrasive grains, generally super abrasive grains such as natural or synthetic diamond abrasive grains or cubic boron nitride abrasive grains has been proposed and come into commercial acceptance recently as disclosed in Japanese Laid-Open Patent Publication No. Sho 56-152562 (U.S. Pat. No. 4,481,738 or European Laid-Open Patent Publication No. 0 039 209) and Japanese Laid-Open Patent Publication No. Sho 57-156157. In this method and apparatus, a holding table to hold a semiconductor wafer is used as well as the above grinding wheel. A semiconductor wafer to be ground at its surface is placed on the holding table and held thereonto. The grinding wheel is rotated about its central axis and the holding table and the grinding wheel are moved relative to each other in a predetermined direction substantially parallel to the surface of the semiconductor wafer placed on the holding table to thus cause the rotating grinding wheel to act on the surface of the semiconductor wafer held onto the holding table to grind it.

It has been found, however, that there are the following problems in the conventional method and apparatus using the grinding wheel. So-called compound semiconductor wafers especially a wafer made of GaAs have recently drawn attention and come into commercial acceptance, but particularly in the surface grinding of these semiconductor wafer, it has been found that sufficiently satisfactory results cannot be obtained and there are unallowable problems that the roughness of the ground surface is relatively large and so-called gouging is observed on the gound surface. On the other hand, as is well known to those skilled in the art, in usual wafers made of Si, large diameter ones whose diameter is about 15 cm (about 6 inches) or about 20 cm (about 8 inches) have come into commercial acceptance, but in the surface grinding of these large diameter wafers made of Si, particularly wafers made of Si whose diameter is about or larger than 20 cm (about 8 inches), it has also been found that problems similar to the above-described problems tend to occur.

SUMMARY OF THE INVENTION

It is a primary object of this invention to improve the above-described method and apparatus for grinding the surface of a semiconductor wafer using the grinding wheel to solve the above-described problems.

It has now been found surprisingly as a result of extensive investigations and experiments of the present inventor about the method and apparatus for grinding the surface of a semiconductor wafer using the grinding wheel that the relative relationship of the crystal orientation in the semiconductor wafer to the grinding direction, i.e. the relative moving direction of the semiconductor wafer held onto the holding table and the grinding wheel has a considerably large influence on the grinding results. Heretofore, a semiconductor wafer has been placed on the holding table without any consideration to the crystal orientation of the semiconductor wafer. Then, the semiconductor wafer has been ground at its surface without any consideration to the relative relationship between the crystal orientation of the semiconductor wafer and the grinding direction. It has now been found that if a semiconductor wafer is placed on the holding table with the angular position of the semiconductor wafer being regulated so as to direct the crystal orientation of the semiconductor wafer in a predetermined direction with respect to the holding table and thus the grinding direction of the surface of the semiconductor wafer by the grinding wheel is set in a predetermined relationship to the crystal orientation of the semiconductor wafer, the grinding results can be much improved and thus the above-described problems can be solved.

Moreover, the present inventor has found that the grinding results can be improved by making the following improvement on the holding table in connection with, or independently of, the above-described relative relationship between the crystal orientation and the grinding direction. At the periphery of the semiconductor wafer is generally formed a deformed portion arranged at a predetermined angular position with respect to its crystal orientation, but in a conventional holding table, its vacuum suction area for sucking the semiconductor wafer has been substantially circular regardless of the existence of the deformed portion. However, if the shape of the vacuum suction area of the holding table is made to substantially correspond to the shape of the semiconductor wafer by forming a deformed portion corresponding to the above deformed portion, the suction of the semiconductor wafer is improved and thus the grinding results are improved.

According to this invention, there is provided, in a method for grinding the surface of a semiconductor wafer comprising placing the semiconductor wafer on a holding table to hold it thereonto, rotating a grinding wheel about its central axis, and moving the holding table and the grinding wheel relative to each other in a predetermined direction substantially parallel to the surface of the semiconductor wafer held onto the holding table to cause the rotating grinding wheel to act on the surface of the semiconductor wafer held onto the holding table, the improvement wherein the semiconductor wafer is placed on the holding table with the angular position of the semiconductor wafer being regulated so as to direct the crystal orientation of the semiconductor wafer in a predetermined direction with respect to the holding table, and thus the grinding direction of the surface of the semiconductor wafer by the grinding wheel is set in a predetermined relationship to the crystal orientation of the semiconductor wafer.

According to this invention, there is further provided, in an apparatus for grinding the surface of a semiconductor wafer comprising a supporting base including at least one holding table to hold the semiconductor wafer, at least one grinding wheel assembly disposed opposite to the supporting base and including a rotatably mounted supporting shaft and a grinding wheel mounted to the supporting shaft, a semiconductor wafer loading means for placing the semiconductor wafer to be ground at its surface on the holding table, and a semiconductor wafer unloading means for unloading the semiconductor wafer which has been ground at its surface from the holding table, said apparatus grinding the surface of the semiconductor wafer by rotating the supporting shaft to rotate the grinding wheel and moving the supporting base and the grindng wheel assembly relative to each other in a predetermined direction substantially parallel to the surface of the semiconductor wafer held onto the holding table to cause the rotating grinding wheel to act on the surface of the semiconductor wafer held onto the holding table, the improvement wherein the semiconductor wafer loading means places the semiconductor wafer on the holding table with the angular position of the semiconductor wafer being regulated so as to direct the crystal orientation of the semiconductor wafer in a predetermined direction with respect to the holding table.

According to this invention, there is still further provided, in an apparatus for grinding the surface of a semiconductor wafer comprising a supporting base including at least one holding table to hold the semiconductor wafer, at least one grinding wheel assembly disposed opposite to the supporting base and including a rotatably mounted supporting shaft and a grinding wheel mounted to the supporting shaft, a semiconductor wafer loading means for placing the semiconductor wafer to be ground at its surfce on the holding table, and a semiconductor wafer unloading means for unloading the semiconductor wafer which has been ground at its surface from the holding table, said apparatus grinding the surface of the semiconductor wafer by rotating the supporting shaft to rotate the grinding wheel and moving the supporting base and the grinding wheel assembly relative to each other in a direction substantially parallel to the surface of the semiconductor wafer held onto the holding table to cause the rotating grinding wheel to act on the surface of the semiconductor wafer held onto the holding table, the improvement wherein a deformed portion arranged at a predetermined angular position with respect to the crystal orientation of the semiconductor wafer is formed at the periphery of the semiconductor wafer, the holding table is made of a porous material and having a vacuum suction area shaped substantially correspondingly to the shape of the semiconductor wafer, and the semiconductor wafer loading means places the semiconductor wafer on the holding table while registering it with the vacuum suction area.

DETAILED DESCRIPTION OF THE PREFERRED EMBODIMENTS

This invention will be described below in detail with reference to the accompanying drawings.

Figure 1:
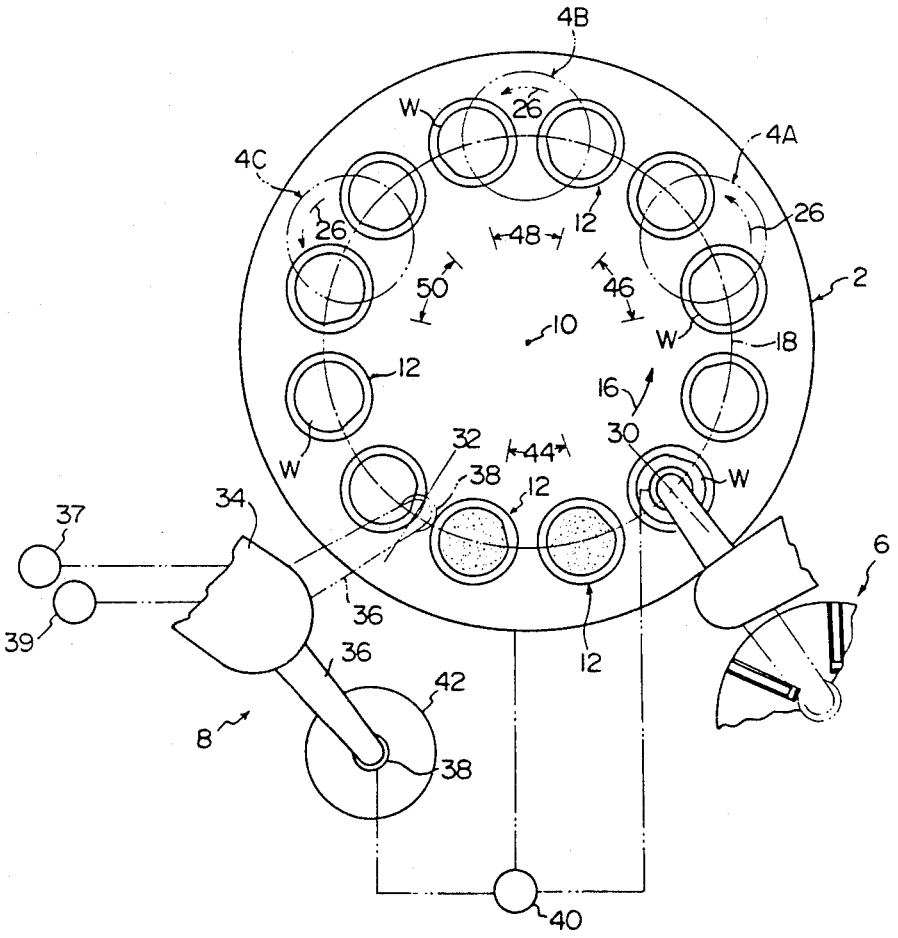
FIG. 1 is a simplified top plan view showing one embodiment of the apparatus improved in accordance with this invention.

With reference to FIG. 1 simply showing one embodiment of the apparatus improved in accordance with this invention, the illustrated apparatus is provided with a supporting base 2, grinding wheel assemblies 4A, 4B and 4C, a semiconductor wafer loading means 6 and a semiconductor wafer unloading means 8.

Figure 2:
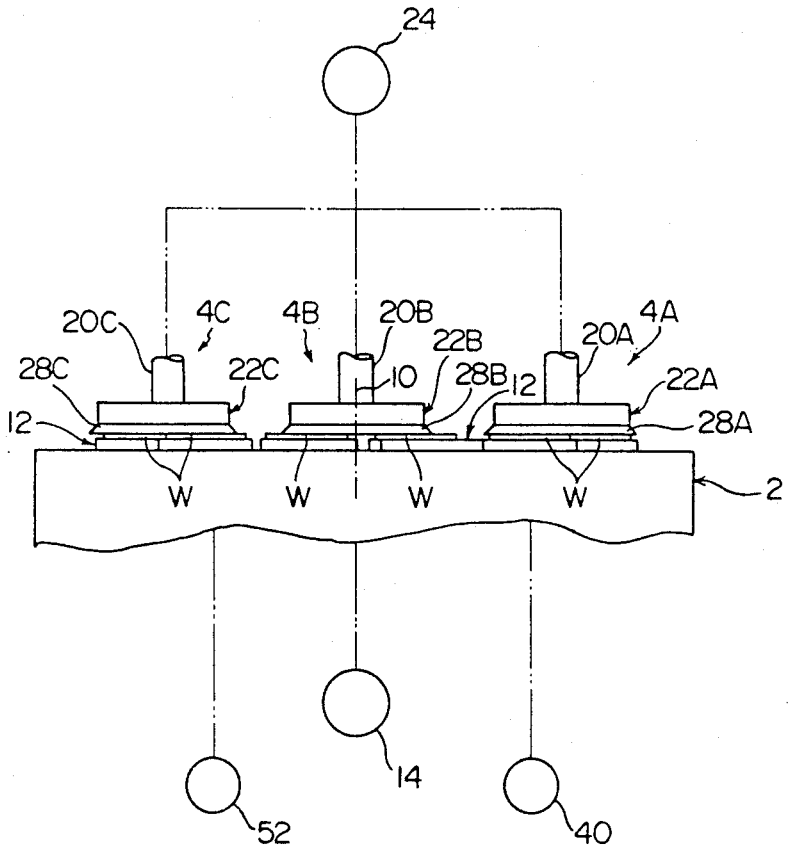
FIG. 2 is a simplified side view showing a supporting base and grinding wheel assemblies in the apparatus of FIG. 1.

With reference to FIG. 2 as well as FIG. 1, the illustrated supporting base 2 is disc-shaped and rotatably mounted about its central axis 10 extending substantially vertically (extending substantially perpendicularly to the paper of FIG. 1). This supporting base 2 is provided with at least one holding table. Twelve holding tables 12 are circumferentially spaced at equal intervals in the illustrated embodiment. Conveniently, the radial distances from the central axis 10 to the holding tables 12 are substantially the same. The supporting base 2 is drivingly connected to a driving source 14 such as an electric motor through a suitable transmitting mechanism (not shown) and rotated in the direction shown by an arrow 16 to thus move each of the holding tables 12 in the direction shown by the arrow 16 along the circular moving passage shown by a one-dot chain line 18. The structure of each of the holding tables 12 itself will be described hereinafter.

With reference to FIG. 1 and FIG. 2, the grinding wheel assemblies 4A, 5B and 4C are disposed opposite to the supporting base 2 above it. The grinding wheel assembly may be one, two or more than four, but in the illustrated embodiment, the three grinding wheel assemblies 4A, 4B and 4C are disposed at intervals in the rotating direction 16 of the supporting base 2, i.e. in the direction 16 of the supporting base 2, i.e. in the direction of the circular moving passage 18 of the holding tables 12. Conveniently, the radial distances from the central axis 10 of the supporting base 2 to the grinding wheel assemblies 4A, 4B and 4C are substantially the same. The grinding wheel assemblies 4A, 4B and 4C respectively include supporting shafts 20A, 20B and 20C mounted adjustably in their vertical positions and rotatably about their central axes extending generally vertically and grinding wheels 22A, 22B and 22C detachably mounted to the lower ends of the supporting shafts 20A, 20B and 20C. The supporting shafts 20A, 20B and 20C are drivingly connected to a driving source 24 such as an electric motor through a suitable transmitting mechanism (not shown) and rotated at high speed in the directions shown by arrows 26. The grinding wheels 22A, 22B and 22C have grinding blades 28A, 28B and 28C preferably annular and formed by bonding super abrasive grains such as natural or synthetic diamond abrasive grains or cubic boron nitride abrasive grains by electrodeposition or any other method.

With reference to FIG. 1, the partially illustrated semiconductor wafer loading means 6 transfers a semiconductor wafer W to be ground at its surface synchronously, as required, with the rotation of the supporting base 2 in the direction shown by the arrow 16 and places the semiconductor wafer W, as required, on the holding table 12 of the supporting base 2 in a loading region shown by a numeral 30. The structure and operation of this semiconductor wafer loading means 6 will be described in detail hereinafter.

The semiconductor wafer unloading means 8 takes out the semiconductor wafer W ground at its surface from the holding table 12 of the supporting base 2 in an unloading region shown by a numeral 32. This semiconductor wafer unloading means 8 can be of any known type. In the illustrated embodiment, it includes a static supporting frame 34, a conveying arm 36 mounted to the supporting frame 34 vertically movably and pivotably between a suction position shown by a two-dot chain line in FIG. 1 and a detachment position shown by a real line in FIG. 1, and a vacuum suction head 38 provided to the under surface of the end portion of the conveying arm 36. The conveying arm 36 is drivingly connected to suitable driving sources 37 and 39 such as electric motors through suitable transmitting mechanisms (not shown), caused to reciprocatingly pivot between the suction position and the detachment position synchronously, as required, with the rotation of the supporting base 2 in the direction shown by the arrow 16, and also vertically moved suitably at the suction position and the detachment position. The vacuum suction head 38 is adapted for selective communication with a suction source 40 such as a vacuum pump or an ejector. When the conveying arm 36 is located at the suction position and lowered to some extent, the vacuum suction head 38 is caused to communicate with the suction source 40 and thus the semiconductor wafer W located on the holding table 12 of the supporting base 2 is sucked to the vacuum suction head 38. Subsequently, the conveying arm 36 is raised to some extent and caused to pivot from the suction position to the detachment position, and thus the semiconductor wafer W is conveyed out from the holding table 12 to the detachment position. When the conveying arm 36 is located at the detachment position and lowered to some extent, the vacuum suction head 38 is separated from the suction source 40 and thus the semiconductor wafer W which has been sucked is detached and placed on a receiver 42 located downward. Thereafter, the conveying arm 36 is raised to some extent and returned to the suction position. The semiconductor wafer W placed on the receiver 42 is washed with a suitable washing means (not shown) to remove grinding chips. Subsequently, the semiconductor wafer W is transferred from the receiver 42 by a suitable transferring means (not shown) which can be constructed with a belt conveyor mechanism, and accommodated in, for example, a receiving cassette (not shown) of any known type.

In the above-described apparatus, the following procedures are successively carried out according to the rotation of the supporting base 2 rotating in the direction shown by the arrow 16. First of all, in a washing region shown by a numeral 44, the surface of the holding table 12 is washed by means of a suitable washing means (not shown) of any known type. (This removes grinding chips from the surface of the holding table 12). Then, in the above-described loading region 30, the semiconductor wafer W is placed on the holding table 12 with its surface to be ground facing upward by means of the semiconductor wafer loading means 6. As will become clear from a description hereinafter, the holding table 12 has a porous vacuum suction area and the semiconductor wafer W placed on the holding table 12 is held by suction thereonto by communication of this vacuum suction area with the suction source 40. Thus, accompanying the holding table 12 the semiconductor wafer W moves substantially parallel to its surface in a predetermined direction, i.e. the direction shown by the arrow 16 along the circular moving passage 18 of the holding table 12. Subsequently, in a first grinding region shown by a numeral 46, the grinding blade 28A of the rotating grinding wheel 22A in the grinding wheel assembly 4A acts on the surface of the semiconductor wafer W to grind it, then, in a second grinding region shown by a numeral 48, the grinding blade 28B of the rotating grinding wheel 22B in the grinding wheel assembly 4B acts on the surface of the semiconductor wafer W to further grind it, and then, in a third grinding region shown by a numeral 50, the grinding blade 28C of the rotating grinding wheel 22C in the grinding wheel assembly 4C acts on the surface of the semiconductor wafer W to still further grind it. Conveniently, in the grinding blades 28A, 28B and 28C of the grinding wheel assemblies 4A, 4B and 4C successively located as seen looking toward the grinding direction, i.e. the direction shown by the arrow 16 along the circular moving passage 18 of the holding table 12, the grinding blade located downstream as seen looking toward the grinding direction is formed of abrasive grains of a smaller grain size therefore, the grain size of the abrasive grains in the grinding blade 28B is smaller that the grain size of the abrasive grains in the grinding blade 28A and the grain size of the abrasive grains in the grinding blade 28C is smaller than the grain size of the abrasive grains in the grinding blade 28B), and thus the grinding roughness of the surface of the semiconductor wafer W is successively decreased toward the downstream as seen looking toward the grinding direction. Conveniently, the grinding depth of the surface of the semiconductor wafer W is also successively decreased toward the downstream as seen looking toward the grinding direction. After passing through the third grinding region 50, the vacuum suction area of the holding table 12 is caused to communicate with a liquid source 52 (FIG. 2) of a liquid such as water and the semiconductor wafer W on the holding table 12 is floated up by the liquid flowing out on the holding table 12. Subsequently, in the above-described unloading region 32, the semiconductor wafer W ground at its surface is taken out from the holding table 12 by means of the semiconductor wafer unloading means 8.

Since the above-described structure and procedures in the illustrated apparatus do not constitute the novel features in the apparatus improved in accordance with this invention and only show one example of an apparatus to which this invention is applicable, a detailed description above the above-described structure and procedures in the illustrated apparatus is omitted in this specification.

In the grinding of the surface of the semiconductor wafer W in the above-described apparatus, the relative relationship between the grinding direction of the surface of the semiconductor wafer W, therefore, the moving direction of the holding table 12 to the grinding wheel assemblies 4A, 4B and 4C, i.e. the direction shown by the arrow 16 along the circular moving passage 18 and the crystal orientation in the semiconductor wafer W has not been heretofore considered at all. In other words, when placing the semiconductor wafer W on the holding table 12 in the loading region 30, the semiconductor wafer W has been placed on the holding table 12 without any consideration on the crystal orientation of the semiconductor wafer W, i.e. without specifying the crystal orientation of the semiconductor wafer W on the holding table 12, and therefore, the grinding has been carried out without specifying the grinding direction of the surface of the semiconductor wafer W with respect to the crystal orientation of the semiconductor wafer W.

It has now been found surprisingly, however, through extensive investigation and experiments of the present inventor that if the relative relationship between the grinding direction and the crystal orientation is different it makes a considerably noticeable difference in the grinding results and that the occurrence of the insufficient grinding surface roughness or so-called gouging on the ground surface which has occurred so far is much caused by the relative relationship between the grinding direction and the crystal orientation. On the basis of the recognition of these facts, the present inventor has now found that it is essential to specify the relative relationship between the grinding direction and the crystal orientation in order to obtain sufficiently good grinding results.

In the above-described apparatus, the grinding direction is the moving direction of the holding table 12 to the grinding wheel assemblies 4A, 4B and 4C and is therefore specified to the direction shown by the arrow 16 along the circular moving passage 18 of the holding table 12. The grinding directions by the grinding wheel assemblies 4A, 4B and 4C with respect to the semiconductor wafer W held onto the holding table 12 are substantially the same. Therefore, when placing the semiconductor wafer W on the holding table 12 in the loading region 30, if the angular position of the semiconductor wafer W is regulated with respect to the crystal orientation in the semiconductor wafer W so as to direct the crystal orientation of the semiconductor wafer W in a predetermined direction with respect to the holding table 12, the grinding directions of the surface of the semiconductor wafer W by the grinding wheel assemblies 4A, 4B and 4C can be made substantially the same and the relative relationship between the crystal orientation of the semiconductor wafer W and the grinding direction can be specified as required.

Figure 3:
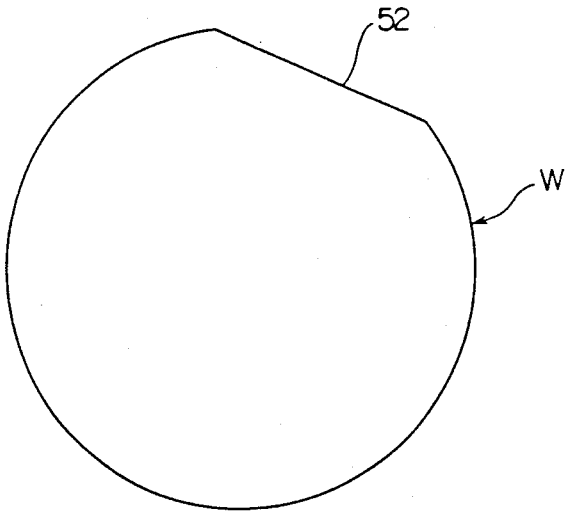
FIG. 3 and FIG. 4 are top plan views showing semiconductor wafers respectively.
Figure 4:
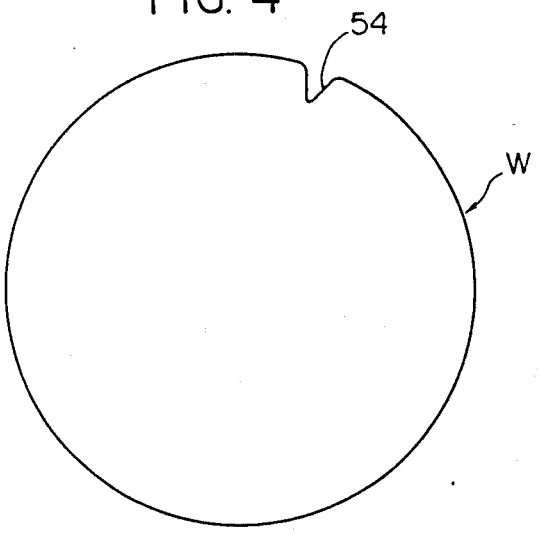

In the meantime, as is well known to those skilled in the art, a deformed portion arranged at a predetermined angular position with respect to the crystal orientation is generally formed at the periphery of the semiconductor wafer W. A typical example of this deformed portion is a flat portion 52 (generally called "an orientation flat") formed at the periphery of the semiconductor wafer W as shown in FIG. 3. Furthermore, the semiconductor wafer W with a V-shaped notch 54 formed at its periphery as shown in FIG. 4 as the deformed portion has recently appeared. Therefore, on the basis of the deformed portion (the flat portion 52, the notch 54 or the like) in the semiconductor wafer W, it is possible to sufficiently easily regulate the angular position of the semiconductor wafer W concerning the crystal orientation to a specific position.

Since the most suitable relative relationship between the crystal orientation of the semiconductor wafer W and the grinding direction is different due to the material of the semiconductor wafer W and the like, it is desirable to decide the most suitable relative relationship by carrying out real grinding experiments using a plurality of dummy wafers. For example, the present inventor carried out grinding experiments of the surface of wafers made of GaAs using the apparatus illustrated in FIG. 1 and FIG. 2 as follows. When the surface of ten wafers made of GaAs was ground without any consideration on the relative relationship between the crystal orientation of the wafers and the grinding direction, i.e. making the relationship of the both free,the grinding surface roughness was 2 to 4 $\mu$m and gouging was observed on the ground surface in all the ten wafers made of GaAs. On the other hand, when the crystal orientation of each of ten wafers made of GaAs was directed toward the grinding direction, i.e. the direction shown by the arrow 16 along the circle shown by a one-dot chain line in FIG. 1 so as to have the most suitable specific relative relationship which had been decided by dummy experiments carried out changing the relative relationship every five degrees and the surface of the ten wafers was ground, the grinding surface roughness was about 0.2 $\mu$m and gouging was not observed on the ground surface.

The semiconductor wafer loading means 6 in the apparatus shown in FIG. 1 is constructed to be able to regulate the angular position, as required, of the semiconductor wafer W shaped as shown in FIG. 3, i.e. the semiconductor wafer W with the flat portion 52 arranged at a predetermined angular position with respect to its crystal orientation and formed at its periphery on the basis of the flat portion 52 and automatically place it on the holding table 12 of the supporting base 2.

Figure 5:
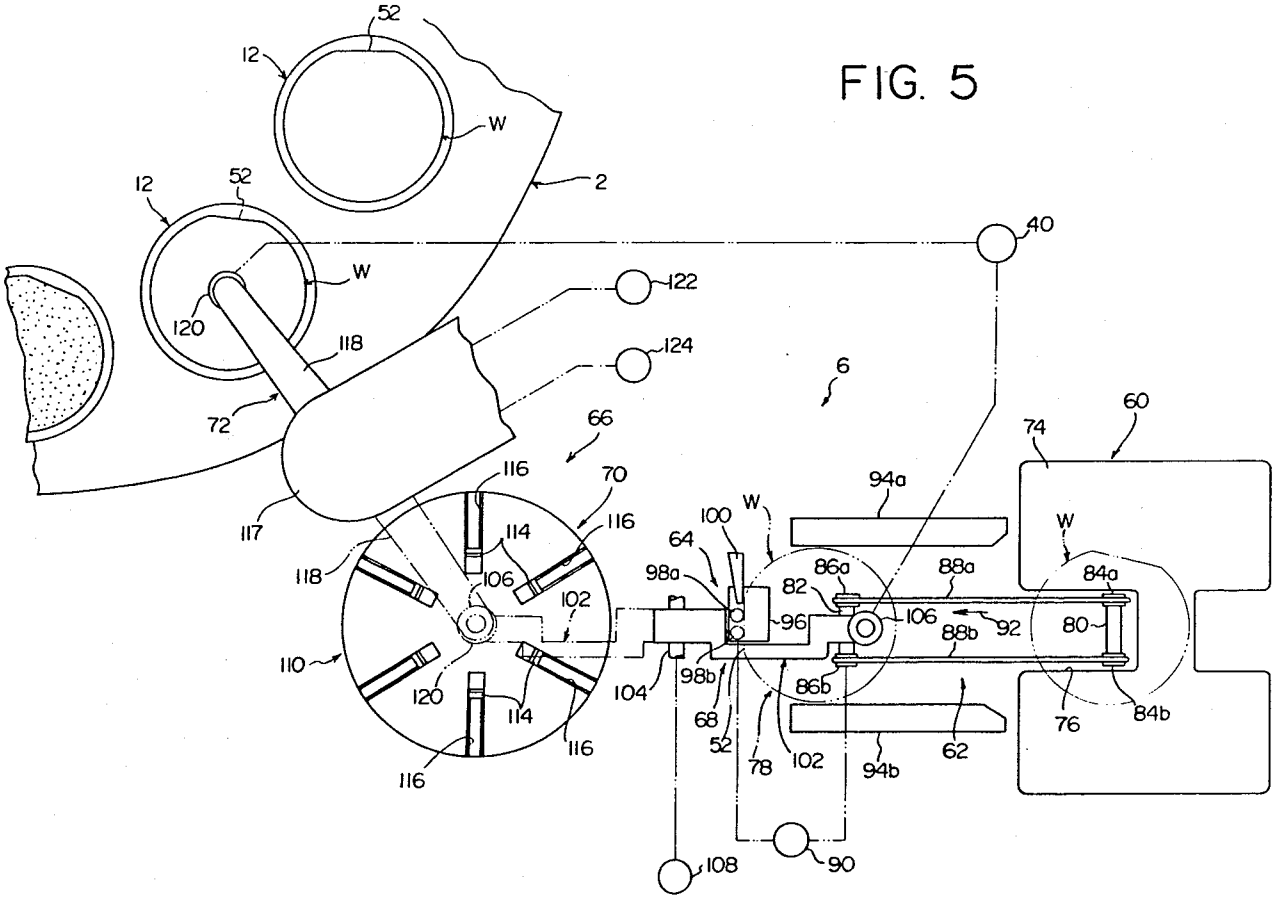
FIG. 5 is a simplified partial top plan view showing a semiconductor wafer loading means in the apparatus of FIG. 1.

With reference to FIG. 5, the illustrated semiconductor wafer loading means 6 includes a receiving cassete 60, a feeding means 62, an angular position regulating means 64 and a transferring means 66. The transferring means 66 comprises a first transferring mechanism 68, a rotation-type angle adjusting means 70 and a second transferring mechanism 72.

The receiving cassette 60 has a plurality of placing plates 74 arranged at intervals vertically (perpendicularly to the paper of FIG. 5) and the semiconductor wafer W is placed on the upper surface of each of the placing plates 74. Each of the placing plates 74 is nearly H-shaped and has a nearly rectangular, relatively large notch 76 at its front central portion. The receiving cassette 60 is loaded in a cassette elevating mechanism (not shown) of any known type and lowered by a predetermined distance (i.e. distance corresponding to the vertical interval of the placing plates 74) whenever the semiconductor wafer W is sent out from the receiving cassette 60 until all the semiconductor wafers W in the receiving cassette 60 are sent out as will be described hereinafter. When all the semiconductor wafers W in the receiving cassette 60 are sent out, the receiving cassette 60 is raised to the initial position and replaced by the next receiving cassette 60 loaded with semiconductor wafers W.

The feeding means 62 takes out the semiconductor wafers W one by one from the receiving cassette 60 and feeds them to a positioning region shown by a numeral 78. The illustrated feeding means 62 is constructed with a belt conveyor mechanism. Namely, the illustrated feeding means 62 comprises a pair of rotating shafts 80 and 82 extending substantially horizontally and disposed at an interval in a lateral direction in FIG. 5, pulleys 84*a* and 84*b* as well as 86*a* and 86*b* fixed to each of the rotating shafts 80 and 82 at intervals in their axial directions, an endless conveyor belt 88*a* wound on the pulleys 84*a* and 86*a* and an endless conveyor belt 88*b* wound on the pulleys 84*b* and 86*b*. The rotating shaft 82 is drivingly connected to a driving source 90 such as an electric motor through a suitable working mechanism (not shown). The driving source 90 is selectively energized, rotates the rotating shaft 82 counterclockwise as seen from the bottom in FIG. 5 and thus drives the endless conveyor belts 88*a* and 88*b* in the direction shown by an arrow 92. As is clearly shown in FIG. 5, the upstream end portion of the feeding means 62 constructed with the belt conveyor mechanism is located in the notch 76 of the placing plate 74 of the receiving cassette 60, and the under surface of the semiconductor wafer W placed on a specific placing plate 74 is made contact with the upper running portion of the endless conveyor belts 88*a* and 88*b* of the feeding means 62 through the notch 76. Therefore, when the endless conveyor belts 88*a* and 88*b* are driven in the direction shown by the arrow 92, the semiconductor wafer W placed on the specific placing plate 74 is taken out from the receiving cassette 60 by an action of the endless conveyor belts 88*a* and 88*b* and conveyed. When the drive of the endless conveyor belts 88*a* and 88*b* is stopped, the receiving cassette 60 is lowered by the above predetermined distance and thus the under surface of the semiconductor wafer W placed on the next placing plate 74 located just above is made contact with the upper running portion of the endless conveyor belts 88*a* and 88*b*. Conveniently, static guide members 94*a* and 94*b* for guiding the semiconductor wafer W taken out and conveyed from the receiving cassette 60 are disposed at both sides (the upper side and the under side in FIG. 5) of the endless conveyor belts 88*a* and 88*b*. Conveniently, the static guide members 94*a* and 94*b* are mounted adjustably in the interval of the both according to a change in the diameter of the semiconductor wafer W.

Figure 6:
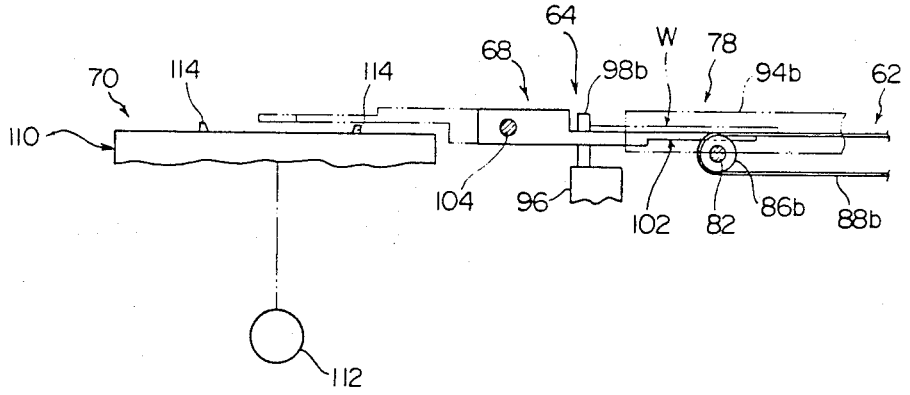
FIG. 6 is a simplified partial side view showing a part of the semiconductor wafer loading means shown in FIG. 5.

The angular position regulating means 64 is disposed to the above-described positioning region 78. In the illustrated embodiment, the semiconductor wafer W of a shape as shown in FIG. 3, i.e. the semiconductor wafer W of a shape with the flat portion 52 arranged at a predetermined angular position with respect to the crystal orientation and formed at its periphery is handled, and the angular position regulating means 64 positions the semiconductor wafer W fed by the feeding means 62 at a predetermined angular position on the basis of its flat portion 52. With reference to FIG. 6 as well as FIG. 5, the illustrated angular position regulating means 64 includes a static supporting frame 96. Conveniently, this supporting frame 96 is mounted adjustably in its lateral position in FIG. 5 and FIG. 6 by means of a suitable supporting means (not shown) so as to be able to meet a change in the diameter of the semiconductor wafer W. A pair of rollers 98*a* and 98*b* upwardly protruding substantially vertically are rotatably mounted to the supporting frame 96. As is clearly shown in FIG. 6, the pair of rollers 98*a* and 98*b* protrude upwardly beyond the upper running portion of the endless conveyor belts 88*a* and 88*b* in the feeding means 62. The pair of rollers 98*a* and 98*b* are drivingly connected to the driving source 90 (i.e. the driving source 90 to which the rotating shaft 82 in the feeding means 62 is drivingly connected) through a suitable transmitting means (not shown) and rotated clockwise in FIG. 5 when the driving source 90 is energized. To the supporting frame 96 is further fixed a stopping piece 100 located above the pair of rollers 98*a* and 98*b* in FIG. 5.

The action of the angular position regulating means 64 is summarized as follows. In the receiving cassette 60, the semiconductor wafers W are positioned at free angular positions and their flat portions 52 are directed in various directions. Therefore, the semiconductor wafers W are fed to the positioning region 78 by the feeding means 62 with their flat portions 52 directed in various directions. When the semiconductor wafer W is fed up to the positioning region 78, the periphery of the semiconductor wafer W is made contact with the pair of rollers 98*a* and 98*b*. Thus, the semiconductor wafer W is prevented from moving forward further and the periphery of the semiconductor wafer W is pushed against the pair of rollers 98*a* and 98*b* by the feeding action of the feeding means 62. Since the pair of rollers 98*a* and 98*b* are being rotated clockwise in FIG. 5 at this time, force to rotate the semiconductor wafer W counterclockwise in FIG. 5 is transmitted from the pair of rollers 98*a* and 98*b* to it. Consequently, the semiconductor wafer W is rotated up to the predetermined angular position where its flat portion 52 is made contact with the stopping piece 100 as well as the pair of rollers 98*a* and 98*b* shown by a two-dot chain line in FIG. 5. At this predetermined angular position, restricting action of the stopping piece 100 prevents the semiconductor wafer W from rotating further. Consequently, the semiconductor wafers W fed with their flat portions 52 directed in various directions are automatically regulated by means of the angular position regulating means 64 into the predetermined angular position, i.e. the angular position where the flat portion 52 is located most frontward as seen looking toward the feeding direction by the feeding means 62 as shown by a two-dot chain line in FIG. 5. The driving source 90 for driving the pair of rollers 98*a* and 98*b* of the angular position regulating means 64 as well as the feeding means 62 is energized for a sufficient time to feed the semiconductor wafer W from the receiving cassette 60 to the positioning region 78 and then position the semiconductor wafer W at the predetermined angular position in this positioning region 78, and deenergized thereafter.

The semiconductor wafer W fed to the positioning region 78 and regulated into the predetermined angular position as described hereinbefore is transferred from the positioning region 78 onto the holding table 12 of the supporting base 2 by means of the transferring means generally shown by the numeral 66. In the illustrated embodiment, the transferring means 66 includes the first transferring mechanism 68, the rotation-type angle adjusting means 70 and the second transferring mechanism 72 as described hereinbefore.

With reference to FIG. 5 and FIG. 6, the first transferring mechanism 68 includes a turnover arm 102. One end portion of the turnover arm 102 is fixed to a supporting shaft 104 extending substantially horizontally and mounted rotatably . A vacuum suction head 106 is provided at the free end of the turnover arm 102. The supporting shaft 104 is drivingly connected to a driving source 108 such as an electric motor through a suitable transmitting mechanism (not shown) and the turnover arm 102 is caused to reciprocatingly pivot between a suction position shown by a real line in FIG. 5 and FIG. 6 and a detachment position shown by a two-dot chain line in FIG. 5 and FIG. 6 by means of the driving source 108 selectively turned and reversed. The vacuum suction head 106 provided at the free end of the turnover arm 102 is adapted for selective communication with the suction source 40. This vacuum suction head 106 faces upward at the suction position, and is located in the positioning region 78 somewhat lower than the upper running portion of the endless conveyor belts 88*a* and 88*b* in the feeding means 62. On the other hand, it faces downward at the detachment position, and is located opposite to the upper surface of a rotating table 110 (the rotating table 110 will be described hereinafter) in the rotation-type angle adjusting means 70. This first transferring mechanism 68 is located at the suction position until the angular position regulating action by the angular position regulating means 64 is completed in the positioning region 78. When the angular position regulating action by the angular position regulating means 64 is completed and the driving source 90 is deenergized, the vacuum suction head 106 is caused to communicate with the suction source 40 and thus the semiconductor wafer W existing in the positioning region 78 is sucked to the vacuum suction head 106. At the same time, the driving source 108 is turned to cause the turnover arm 102 to pivot counterclockwise in FIG. 6 from the suction position to the detachment position, and thus the semiconductor wafer W is transferred upside down from the positioning region 78 to the upper surface of the rotating table 110. Then, the vacuum suction head 106 is separated from the suction source 40, and thus the semiconductor wafer W is detached from the vacuum suction head 106 and placed on the rotating table 110. Subsequently, the turnover arm 102 is returned from the detachment position to the suction position.

The rotating table 110 in the rotation-type angle adjusting means 70 is rotatably mounted about its axis extending substantially vertically and drivingly connected to a driving source 112 (FIG. 6) which is conveniently a pulse motor through a suitable transmitting means (not shown). On the surface of the substantially horizontal rotating table 110, a plurality of (six, in the illustrated embodiment) cramping nails 114 for cramping free movement of the semiconductor wafer W placed thereon are disposed at circumferentially spaced positions. Conveniently, each of these cramping nails 114 is mounted adjustably in its radial position to a groove 116 extending radially and formed in the surface of the rotating table 110 to meet a change in the diameter of the semiconductor wafer W. In this rotation-type angle adjusting means 70, after the semiconductor wafer W is placed on the rotating table 110 by means of the first transferring mechanism 68, the driving source 112 is energized to rotate the rotating table 110 and the semiconductor wafer W placed thereon by a predetermined angle. Thus, the angular position of the semiconductor wafer W regulated to the predetermined angular position in the positioning region 78 is suitably adjusted so as to set the angular position, i.e. the crystal orientation of the semiconductor wafer W in a required relationship to the moving direction of the holding table 12, i.e. the grinding direction when the semiconductor wafer W is transferred from the rotating table 110 onto the holding table 12 of the supporting base 2 by the second transferring mechanism 72 (the second transferring mechanism 72 will be described hereinafter). If it is unnecessary to adjust the angular position of the semiconductor wafer W in the rotation-type angle adjusting means 70 in order to set the angular position of the semiconductor wafer W in a required relationship to the moving direction of the holding table 12, it is, of course, unnecessary to energize the driving source 112, and the rotation-type angle adjusting means 70 can be omitted when handling only this special kind of semiconductor wafers W.

The second transferring mechanism 72 includes a static supporting frame 117, a conveying arm 118 mounted to the supporting frame pivotably between a suction position shown by a two-dot chain line in FIG. 5 and a detachment position shown by a real line in FIG. 5, and a vacuum suction head 120 provided to the under surface of the end portion of this conveying arm 118. The conveying arm 118 is drivingly connected to suitable driving sources 122 and 124 such as electric motors through suitable transmitting mechanisms (not shown), caused to reciprocatingly pivot between the suction position and the detachment position synchronously, as required, with the rotation of the supporting base 2 in the direction shown by the arrow 16, and also vertically moved suitably at the suction position and the detachment position. The vacuum suction head 120 is adapted for selective communication with the suction source 40. When the adjustment of the angular position of the semiconductor wafer W is completed in the rotation-type angle adjusting means 70, the conveying arm 118 at the suction position is lowered to some extent and then the vacuum suction head 120 is caused to communicate with the suction source 40. Thus, the semiconductor wafer W on the rotating table 110 of the rotation-type angle adjusting means 70 is sucked to the vacuum suction head 120. Subsequently, the conveying arm 118 is raised to some extent and caused to pivot from the suction position to the detachment position. Then, the conveying arm 118 is lowered to some extent and the vacuum suction head 120 is separated from the suction source 40, and thus the semiconductor wafer W which has been sucked is detached and placed on the holding table 12 of the supporting base 2 located downward. Thereafter, the conveying arm 118 is raised to some extent and returned to the suction position from the detachment position.

In the illustrated apparatus improved in accordance with this invention, some improvement is also applied to the holding table 12 itself in connection that the semiconductor wafer W is placed on the holding table 12 of the supporting base 2 at a predetermined angular position by the above-described semiconductor wafer loading means 6.

Figure 7:
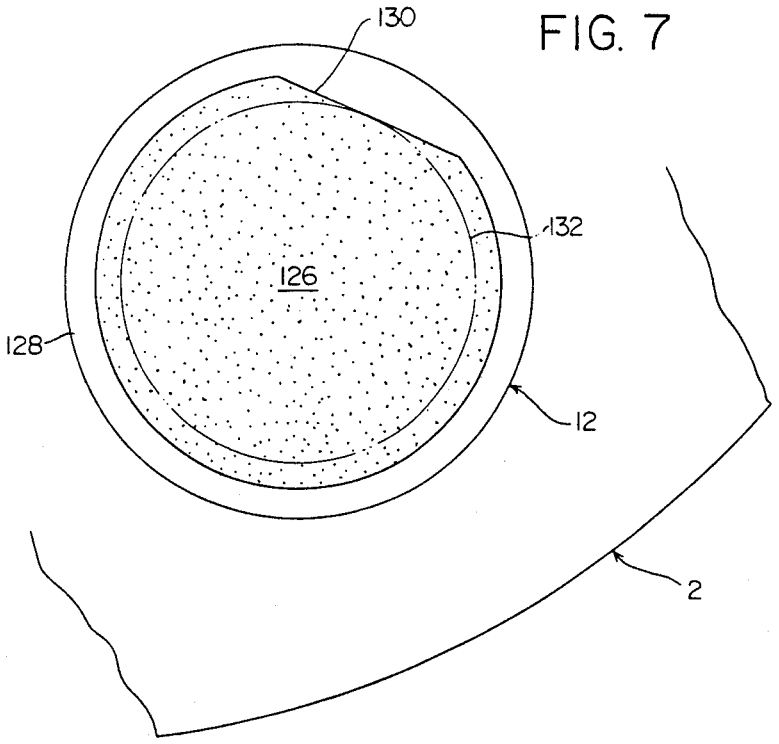
FIG. 7 is a partial top plan view showing a holding table in the apparatus of FIG. 1.

With reference to FIG. 7, each of the holding tables 12 in the illustrated embodiment comprises a main portion 126 formed of a porous material such as a porous ceramics and a peripheral portion 128 formed of a non-porous material and surrounding the main portion 126. The main portion 126 formed of a porous material is caused to communicate with the suction source 40 (FIG. 1 and FIG. 2) through a suitable suction passage (not shown) disposed in the supporting base 2 to thus suck the semiconductor wafer W placed on the holding table 12. Therefore, the main portion 126 defines a vacuum suction area. In the illustrated holding table 12 improved in accordance with this invention, the main portion 126 which defines a vacuum suction area is shaped into substantially the same shape with the shape of the semiconductor wafer W placed thereon. Since the semiconductor wafer W of a shape as shown in FIG. 3, i.e. the semiconductor wafer W of a shape with the flat portion 52 formed at its periphery is handled in the illustrated embodiment, the main portion 126 is of a plane shape which is substantially the same with the semiconductor wafer W of a shape as shown in FIG. 3, and has a flat portion 130 at its periphery. The semiconductor wafer W to be placed on the holding table 12 by the semiconductor wafer loading means 6 is placed on the main portion 126 at the angular position in which its flat portion 52 is coincident with the flat portion 130 of the main portion 126. Thus, the substantially whole area of the main portion 126, i.e. the vacuum suction area is covered with the substantially whole body of the semiconductor wafer W. Therefore, the semiconductor wafer W is subject to the suction action uniformly enough throughout its substantially whole body to be firmly held by suction. Whent he semiconductor wafer W of a shape with the V-shape notch 54 formed at its periphery as shown in FIG. 4 is handled, the plane shape of the main portion 126 can be, of course changed into a shape which is substantially the same with the shape of this semiconductor wafer W.

With respect to the holding table 12, the following should be noted. The semiconductor wafer W has heretofore been placed on the holding table 12 at a free angular position without regulating it to a specific angular position, therefore, with its flat portion 51 (or notch 54) directed in a free direction. Then, as shown by a two-dot chain line 132 in FIG. 7, only a circular region inscribed to the flat portion 52 (or the notch 54) of the semiconductor wafer W or a circular region a little smaller than that has been made a vacuum suction area made of a porous material and its outer region has been made of a non-porous material to thus cause the whole vacuum suction area to be necessarily covered with the semiconductor wafer W even if the semiconductor wafer W has been placed at a free angular position. (As is easily understood, if a part of the vacuum suction area is not covered with the semiconductor wafer W, a high ability suction source becomes necessary, and even if the suction source 40 with a high ability is used, it is considerably difficult to such the semiconductor wafer W firmly enough.) In the above-described conventional structure, however, as is easily understood, the peripheral region of the semiconductor wafer W is not vacuum-sucked and therefore the peripheral region of the semiconductor wafer W tends to be raised a little during its grinding, which has caused the problem of insufficient grinding results of the semiconductor wafer W.

While the method and the apparatus of the invention have been described hereinabove with regard to their one specific embodiment shown in the attached drawings, it should be understood that the invention is not limited to this embodiment alone, and various changes and modifications are possible without departing from the scope of this invention.

For example, in the illustrated embodiment, the semiconductor wafer W fed to the positioning region 78 from the receiving cassette 60 is placed on the holding table 12 after it is turned upside down by means of the first transferring mechanism 68, but if desired, it is possible to put the semiconductor wafer W into the receiving cassette 60 with its surface to be ground facing upward and place it on the holding table 12 without turning it upside down.

In the illustrated embodiment, the semiconductor wafer W is mechanically regulated into the specific angular position by means of the angular position regulating means 64 in the positioning region 78 and then the angular position of the semiconductor wafer W is further adjusted by means of the rotation-type angle adjusting means 70, but, if desired, for example, the angular position regulating means 64 can be omitted and an optical detector or the like for detecting the flat portion 52 (or the notch 54) of the semiconductor wafer W can be additionally disposed to the rotation-type angle adjusting means 70 to set up the angular position of the semiconductor wafer W as required only in the rotation-type angle adjusting means 70 on the basis of the detection of the angular position of the semiconductor wafer W by the above detector.

Furthermore, instead of adjusting the angular position of the semiconductor wafer W by rotating the rotating table 110 in the rotation-type angle adjusting means 70, for example, the vacuum suction head 120 in the second transferring mechanism 72 (or the vacuum suction head 106 in the first transferring mechanism 68) can be made rotatable with respect to the conveying arm 118 (or the turnover arm 102) to adjust the rotation angle of the semiconductor wafer W by rotating the vacuum suction head 120 (or 106) by a required angle while transferring the semiconductor wafer W by the second transferring mechanism 72 (or the first transferring mechanism 68).

What is claimed is:

1. In an apparatus for grinding the surface of a semiconductor wafer which has its periphery provided with a deformed portion arranged at a predetermined angular position with respect to the crystal orientation, said apparatus comprising a supporting base including at least one holding table to hold the semiconductor wafer, at least one grinding wheel assembly disposed opposite to the supporting base and including a rotatably mounted supporting shaft and a grinding wheel mounted to the supporting shaft, a semiconductor wafer loading means for placing the semiconductor wafer to be ground at its surface on the holding table, and a semiconductor wafer unloading means for unloading the semiconductor wafer which has been ground at its surface from the holding table, said apparatus grinding the surface of the semiconductor wafer by rotating the supporting shaft to rotate the grinding wheel and moving the supporting base and the grinding wheel assembly relative to each other in a predetermined direction substantially parallel to the surface of the semiconductor wafer held onto the holding table to cause the rotating grinding wheel to act on the surface of the semiconductor wafer held onto the holding table, the improvement wherein the semiconductor wafer loading means places the semiconductor wafer on the holding table with the angular position of the semiconductor wafer being regulated so as to direct the crystal orientation of the semiconductor wafer in a predetermined direction with respect to the holding table; said semiconductor wafer loading means including a feeding means for feeding the semiconductor wafer to a positioning region, an angular position regulating means for positioning the semiconductor wafer fed to the positioning region at a predetermined angular position on the basis of the deformed portion, and a transferring means for transferring the semiconductor water positioned at the predetermined angular position from the positioning region onto the holding table, said transferring means including rotation-type angular position adjusting means for rotating a semiconductor held thereon to adjust the angular position of the semiconductor wafer with respect to the holding table, said angular position adjusting means comprising a rotatably mounted rotating base and a driving source for rotating the rotating base, said transferring means also including a first transferring mechanism for transferring the semiconductor wafer from the positioning region onto the rotating base and a second transferring mechanism for transferring the semiconductor wafer from the surface of the rotating base onto the holding table and for orienting the wafer on the holding table in the predetermined direction.

2. The apparatus of claim 1 wherein the holding table is made of a porous material and has a vacuum suction area shaped substantially correspondingly to the shape of the semiconductor wafer, and the semiconductor wafer loading means places the semiconductor wafer on the holding table while registering it with the vacuum suction area.

3. The apparatus of claim 1 wherein the supporting base is disc-shaped and rotatably mounted about its central axis, the supporting base is provided with a plurality of said holding tables circumferentially spaced at intervals and being substantially equidistant from the central axis, and the relative movement of the supporting base and the grinding wheel assembly is caused by rotating the supporting base.

4. The apparatus of claim 3 wherein a plurality of said grinding wheel assemblies spaced at intervals in the rotating direction of the supporting base and being substantially equidistant from the central axis of the supporting base are provided.

5. The apparatus of claim 4 wherein the grinding wheel of each of the grinding wheel assemblies has a grinding blade formed of super abrasive grains, and the grain size of the super abrasive grains in the grinding blade of the grinding wheel located downstream as seen looking toward the grinding direction is smaller than the grain size of the super abrasive grains in the grinding blade of the grinding wheel located upstream as seen looking toward the grinding direction.

* * * * *